US006111224A

United States Patent [19]

Witt

[11] Patent Number: 6,111,224

[45] Date of Patent: Aug. 29, 2000

[54] FOOD WARMING OVEN WITH TRANSPARENT HEATING SHELVES

[75] Inventor: Allan E. Witt, Brown Deer, Wis.

[73] Assignee: Hatco Corporation, Milwaukee, Wis.

[21] Appl. No.: 09/452,965

[22] Filed: Dec. 2, 1999

[51] Int. Cl.[7] ..... H05B 3/26

[52] U.S. Cl. ..... 219/385; 219/214; 219/218; 219/543

[58] Field of Search ..... 219/385, 386, 219/392, 395, 396, 411, 203, 214, 218, 543; 222/146.5; 99/467; 392/439

[56] References Cited

U.S. PATENT DOCUMENTS

| | | | |
|---|---|---|---|
| 2,119,680 | 6/1938 | Long . | |
| 2,571,218 | 10/1951 | Buttero . | |
| 3,876,862 | 4/1975 | Newman et al. . | |
| 4,459,470 | 7/1984 | Shlichta et al. | 219/203 |
| 4,469,936 | 9/1984 | Hunter . | |
| 4,889,974 | 12/1989 | Auding et al. | 219/543 |
| 4,970,376 | 11/1990 | Mellor et al. . | |
| 5,056,332 | 10/1991 | Tajima et al. | 62/252 |
| 5,119,467 | 6/1992 | Barsky et al. . | |
| 5,352,869 | 10/1994 | Barsky . | |
| 5,508,198 | 4/1996 | Ganz et al. | 435/303.1 |
| 5,698,262 | 12/1997 | Soubeyrand et al. . | |
| 5,780,820 | 7/1998 | Komyoji et al. | 219/543 |
| 5,798,142 | 8/1998 | Soubeyrand . | |
| 5,852,284 | 12/1998 | Teder et al. . | |
| 5,880,434 | 3/1999 | Pinnow et al. | 219/386 |
| 5,981,914 | 11/1999 | Schultheis | 219/452.11 |

OTHER PUBLICATIONS

"Glo–Ray® Designer Heated Display Cases (Models GRCD–1P, –2P, –3P; GRCDH–1P, –2P, –3P; GRCD–1PD, –2PD, –3PD; and GRCDH–1PD, –2PD, –3PD)"; 2–pg. document; Hatco Corporation; Form No. GRCD–1099(S); [Date Unknown].

*Primary Examiner*—Joseph Pelham
*Attorney, Agent, or Firm*—Foley & Lardner

[57] ABSTRACT

A food warming oven for holding and warming food items includes a base, a frame extending upward from the base, and at least one generally transparent heating shelf disposed above the base by the frame. Each shelf is configured to support food items, and each shelf includes a transparent substrate and a transparent resistive coating deposited on the substrate. The food warming oven also includes a power feed electrically coupled to the resistive coating of each transparent heating shelf to heat that shelf and the food items supported by that shelf. Due to the generally transparent nature of each heating shelf, the food items disposed below the heating shelf are viewable from overhead the heating shelf.

37 Claims, 3 Drawing Sheets

FOOD WARMING OVEN WITH TRANSPARENT HEATING SHELVES

FIELD OF THE INVENTION

The invention relates generally to the field of warming ovens or serving stations for holding items, such as food items, at elevated temperatures. More particularly, the invention relates to a food warming oven with at least one transparent heating shelf for holding and warming food items, wherein food items placed below the transparent heating shelf can be seen through the transparent shelf.

BACKGROUND OF THE INVENTION

Food warming ovens for holding and warming food items and for keeping prepared foods at elevated temperatures while in inventory prior to sale at restaurants, food counters, cafeterias, etc. are known. Such food warming ovens typically include one or more shelves for supporting prepared items of food (e.g., hamburgers, French fries, casseroles, etc.), and are capable of generating heat for warming the items supported by each shelf. A bottom heat source typically warms the food items from beneath using conducted heat. A top heat source warms the food items from overhead using heat lamps or infrared heat sources suspended above the food items using an appropriate overhead structure. The food items may also be warmed by convected heat from a warm stream of air aimed at the items.

Such food warming ovens, however, have a significant drawback. The user of such a food warming oven (i.e., the food service customer) has reduced visibility of any food items placed on a lower holding surface of the oven. The shelf or shelves of such known food warming ovens, which are typically made of a metal, partially or completely block the user's view of food items placed on lower shelves or lower food holding surfaces. This can require the user to stoop or bend to fully view food items placed on the lower holding surfaces or shelves, even when no food items are actually present on the upper holding surfaces. This configuration tends to make the food items on the lower holding surfaces or shelves less desirable than the food items placed on an upper shelf in full view of the user. This configuration also makes monitoring and maintaining the condition of the food items placed on lower holding surfaces more difficult due to the restricted view of these food items.

Accordingly, it would be advantageous to provide a food warming oven including at least one transparent heating shelf that overcomes these and other disadvantages. In particular, it would be advantageous to provide a food warming oven with at least one transparent heating shelf that maximizes the visibility of even those food items placed beneath that shelf. It would also be advantageous to provide a food warming oven including a transparent shelf capable of supporting and heating food items. The use of one or more transparent heating shelves would allow food items placed on lower holding surfaces or shelves to be more visible and desirable to the user or prospective consumer, and be more easily monitored and maintained by the food service personnel. Further, it would be advantageous to provide a heat source of sufficient power capacity to warm food items and maintain such items at elevated temperatures by distributing heat across a transparent shelf. It would be advantageous to provide a heat source for a food warming oven having a relatively simple structure with no moving parts for improved reliability and maintainability.

SUMMARY OF THE INVENTION

One embodiment of the invention relates to a food warming oven for holding and warming food items which includes a base, a frame extending upward from the base, and at least one generally transparent heating shelf disposed above the base by the frame. Each transparent shelf is configured to support at least one food item, and each shelf includes a transparent substrate and a transparent resistive coating deposited on the substrate. The oven also includes a power feed electrically coupled to the resistive coating of the at least one heating shelf to heat that shelf and the at least one food item supported by that shelf. With this oven, any food items disposed below the transparent heating shelf are viewable from overhead that shelf.

Another embodiment of the invention relates to a generally transparent shelf for holding and warming food items which includes a substrate, a resistive coating disposed on the substrate, and a cover coupled to the substrate.

Another embodiment of the invention relates to a method of warming and holding food items using a food warming oven. The oven includes a base, a frame, at least one generally transparent heating shelf disposed above the base by the frame, each shelf having a resistive coating deposited on a glass substrate, and a power feed electrically coupled to the coating. The method includes the steps of placing food items above and below the transparent shelf, and generating heat by applying power to the resistive coating, wherein the food items placed above and below the transparent heating shelf are heated while the food items placed below the transparent heating shelf are viewable by a user from above the transparent shelf.

BRIEF DESCRIPTION OF THE DRAWINGS

The invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1:
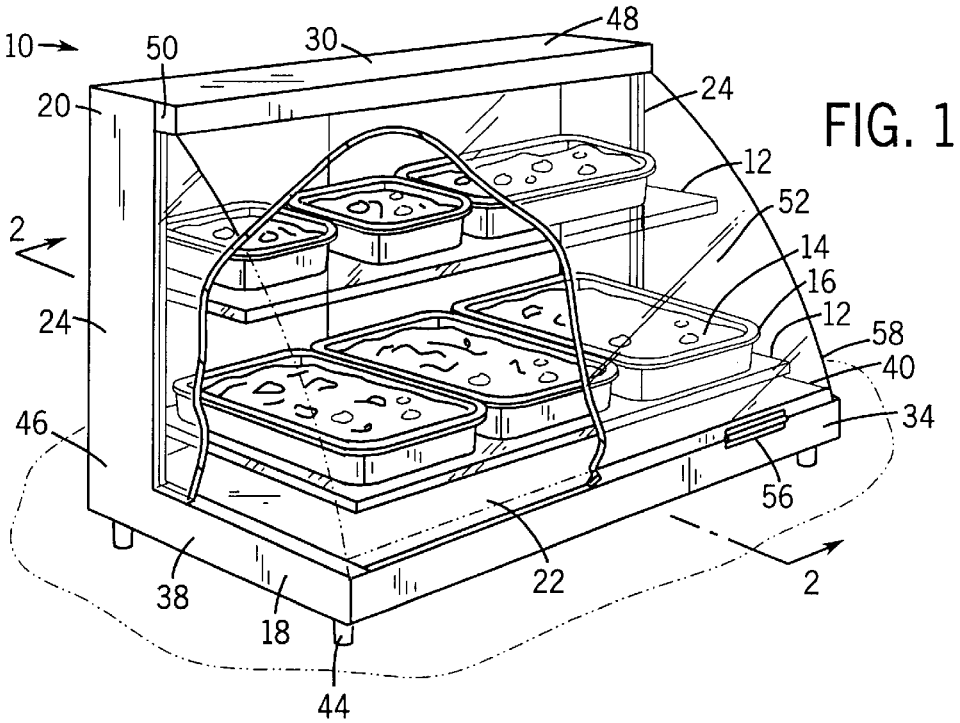
FIG. 1 is a front perspective view of a food warming oven with a plurality of transparent heating shelves in accordance with an embodiment of the present invention.
Figure 2:
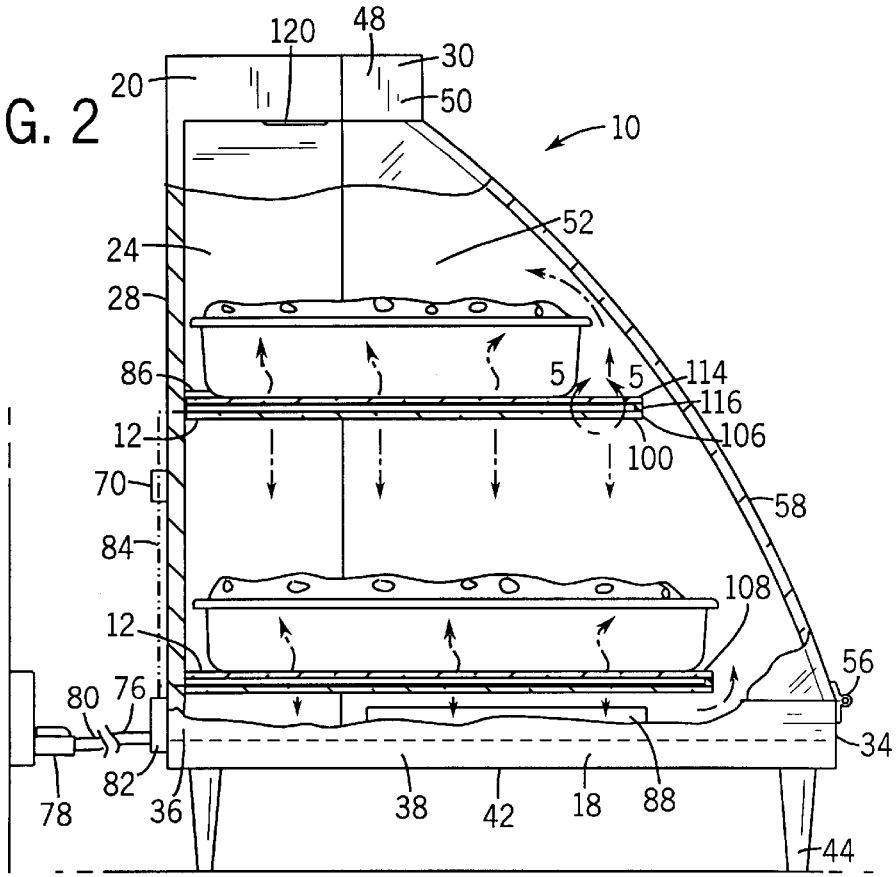
FIG. 2 is a cross-sectional view of the food warming oven of FIG. 1 taken along line 2—2 of FIG. 1.

Referring to FIGS. 1 and 2, a food warming oven 10 includes a plurality of transparent heating shelves 12 for warming and holding food items 14 such as casseroles, pastas, cooked vegetables, etc. stored within serving pans 16. Alternatively, the food items can be placed directly onto shelves 12 without the need for a serving pan 16, as in the case of a foil-wrapped baked potato. Food warming oven 10 includes a rectangular base 18, and a frame 20 that extends upwardly from base 18. Frame 20 is secured by, for example, welding or fasteners such as screws. Shelves 12 are removably connected to frame 20 and are positioned above base 18. Frame 20 includes side walls 24 and a rear wall 28 fixedly secured to base 18 and upwardly and perpendicularly extending from base 18. Side walls 24 and rear wall 28 are fixedly secured by welding or by fasteners, such as screws inserted through apertures (not shown). Frame 20 further includes a top section 30 secured to side walls 24 and rear wall 28. Food items 14, with or without a serving pan 16, may be placed on shelves 12 through, for example, a door within rear wall 28. Those food items 14 placed below the top shelf 12 (i.e., those food items 14 placed on the lower shelf 12) are viewable from above the top shelf 12 due to the generally transparent feature of shelves 12. Note either or both shelves 12 can be generally transparent.

Referring further to FIGS. 1 and 2, base 18 has a forward end 34 positioned opposite a rear wall supporting end 36, a first side 38 positioned opposite a second side 40, and an underside 42 positioned opposite a generally horizontal upper surface 22. Base 18 includes four adjustable legs 44 attached to underside 42 of base 18 to maintain food warming oven 10 in an elevated position above a floor. Side walls 24 each include a bottom portion 46 secured by welding or fasteners such as screws to sides 38 and 40 of base 18, respectively, to contact rear wall supporting end 36 of base 18, therein leaving a substantial portion of the sides of food warming oven 10 open for side viewing by a user (e.g., an employee, consumer, purchaser, etc.). Top section 30 has a front portion 48 including an overhang 50 that forwardly extends front portion 48 beyond side walls 24. The widths of side walls 24 are substantially smaller than the widths of first and second sides 38 and 40 of base 18.

Base 18, side walls 24, rear wall 28 and top section 30 of frame 20 define a food display area 52 for displaying food items 14. Hinges 56 removably attach a generally transparent lid 58 to forward end 34 of base 18. Lid 58 extends upwardly and rearwardly from forward end 34 of base 18 to front portion 48 of top section 30. Lid 58 substantially covers area 52 for displaying food items 14 without substantially contacting shelves 12 or food items 14 placed on shelves 12 in display area 52. Hinges 56 allow for lid 58 to be tilted forward about an axis positioned parallel to forward end 34 of base 18 for easy cleaning of lid 58 and display area 52. According to one embodiment, the lid is made of curved tempered glass. Of course, other configurations of lid 58 can be used, and one or more lids 58 may each cover only a portion of the front of the food warming oven.

Figure 3:
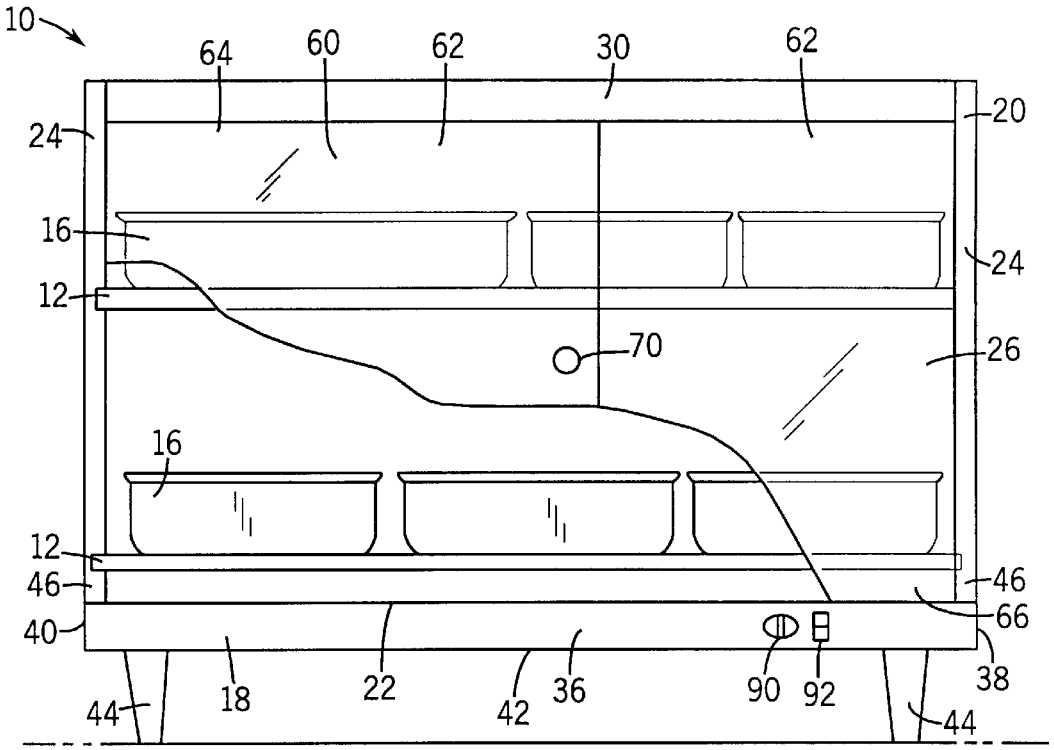
FIG. 3 is a rear elevation view of the food warming oven of FIG. 1.

Referring to FIG. 3, rear wall 28 includes a generally transparent sliding door 60 (or french doors) slidably attached to base 18 and top section 30. In one embodiment, rear wall 28 is made of glass. Door 60 provides access to display area 52 which can be used to place food items 14 on shelves 12 for sale to the users, and to remove unsold food items 14 at the end of the day, or if the food items have become stale. Door 60 includes panels 62 each having a top end 64, and a bottom end 66. Panels 62 are positioned adjacent to and in overlapping relationship to each other and are formed into rear wall supporting end 36 of base 18 and top section 30. Rails support top ends 64 and bottom ends 66 of panels 62 allowing for translational movement of each panel 62 with respect to the other panel. A pull or handle 70 is connected to outer panel 62 of door 60 to facilitate opening and closing of door 60. According to the embodiment in FIG. 1, the width of each panel is slightly greater than one half of the width of rear wall 28 to ensure that rear wall 28 is completely covered by the overlapping panels 62 when panels 62 are in a closed position.

Referring back to FIG. 2, an electric power feed 76 is connected to food warming oven 10 through a plug 78 attached to an electric cord 80. Cord 80 is connected to rear wall supporting end 36 of base 18 via a heavy duty cord grip connector 82. Electric power feed 76 extends through frame 20 via a supply line 84 that electrically connects to a resistive coating 86 disposed within each heating shelf 12 and, optionally, to an additional heat source 88 located in base 18 and/or a light 120 located in top section 30 and disposed to provide light on food items 14 in oven 10. Electricity powers shelves 12 and, optionally, heat source 88 and/or light 120.

Figure 4:
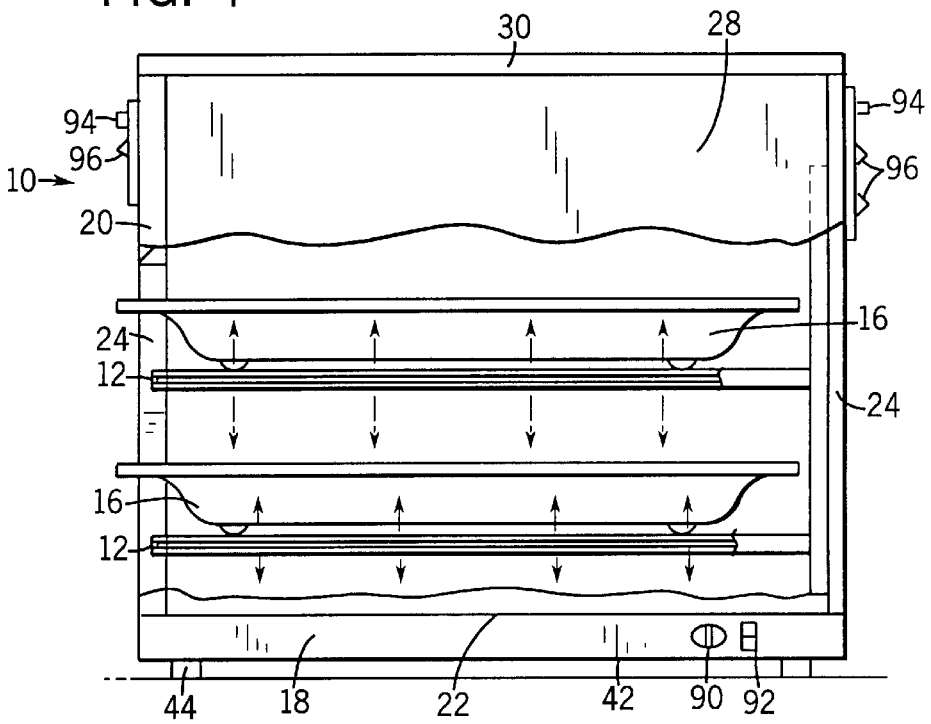
FIG. 4 is a rear elevation view of a food warming oven according to an alternative embodiment of the present invention.

Referring back to FIG. 3, a thermostat 90 for sensing the temperature of warming oven 10, and a switch 92 selectable between an on position and an off position for turning food warming oven 10 on and off, are connected to rear wall supporting end 36 of base 18. According to the alternative embodiment in FIG. 4, additional thermostatic controls 94 and switches 96 may be installed to frame 20 to provide sectional thermostatic temperature control of different sections of oven 10.

Figure 5:
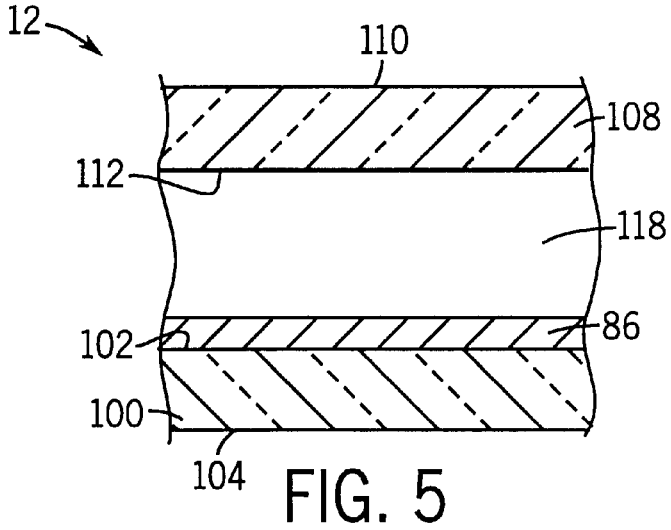
FIG. 5 is a fragmentary, sectional view of a transparent heating shelf according to an embodiment of the present invention taken along line 5—5 of FIG. 2.

Referring to FIGS. 2 and 5, a fragmentary, sectional view of shelf 12 is shown. Shelf 12 includes a substrate 100 having an upper surface 102, a lower surface 104 and a substrate edge 106 that extends around the periphery of substrate 100. Shelf 12 also includes a conductive coating 86 bonded to upper surface 102 of substrate 100, and a cover 108 mounted in a spaced apart orientation over substrate 100 and having an upper surface 110, a lower surface 112 and a cover edge 114 extending around the periphery of cover 108. In one embodiment, cover 108 is mounted in a spaced apart orientation to substrate 100 by an insert 116 sealed to cover edge 114 and substrate edge 106 to define a cavity 118 within generally transparent heating shelf 12. In one embodiment, the substrate and cover are made of glass. In an alternative embodiment, the substrate edge and the cover edge are thermally and hermetically bonded thereby defining the cavity within the shelf.

In a preferred embodiment, the conductive coating includes at least one layer of tin oxide deposited on the substrate using the method described in U.S. Pat. No. 5,798,142 to Soubeyrand, the entirety of which is herein incorporated by reference. In this method, molten glass is delivered from a melting furnace to a float bath section in which a continuous glass ribbon is formed in accordance with a well known float process. The glass ribbon is advanced from the float bath section through an adjacent annealing lehr and a cooling section. The float bath section includes a bottom section within which a bath of molten tin is contained. The tin bath is maintained in a non-oxidizing atmosphere to prevent oxidation of the molten tin. Molten glass is flowed on to the surface of the tin bath in controlled amounts. The molten glass is spread laterally, under the influences of gravity and surface tension, and is advanced across the bath to form the ribbon. A glass article made in accordance with the Soubeyrand method may include a coating of a single layer of a silica complex, or there may be provided a multi-layered coating wherein the silica complex comprises any one or more of the layers. Various layers may include, in various combinations, coatings of silicon, metallic oxide, metallic nitride, metallic carbides, the silica complex, etc. The multi-layered coating may comprise up to seven or more layers in order to achieve a desired optical effect. A plurality of gas distributors within the float bath section and/or within the lehr may be used to lay down the various coatings. The gas distributor beams extend transversely over the lehr over the glass ribbon as it is conveyed through the lehr. Additional distributor beams may be provided within the float bath and the annealing lehr for application of additional layers as desired.

Figure 6:
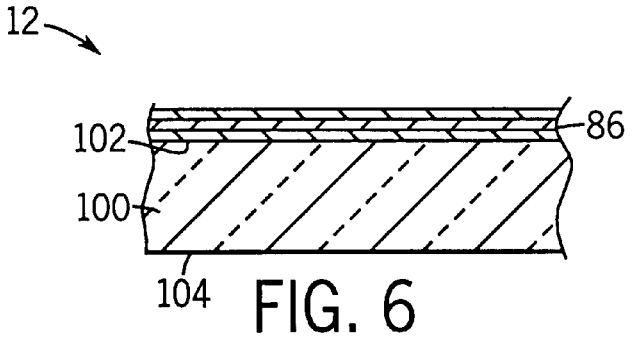
FIG. 6 is a fragmentary, sectional view of a coated shelf according to an alternative embodiment of the present invention.

In an alternative embodiment of shelf 12 shown in FIG. 6, substrate 100 and conductive coating 86 may include a chemical vapor deposition ("CVD") pyrolitically coated transparent electrically conductive glass (TEC) made according to the Soubeyrand method. Shelf 12 can be manufactured with substrate 100 and conductive coating 86 in continuous contact without defining a cavity. In another embodiment, the conductive coating includes at least one layer of a silica complex, a metallic oxide, a metallic nitride or a metallic carbide or a combination thereof.

In a preferred embodiment, the layer of tin oxide has sufficient thickness to produce a power density of at least 1.5 watts per square inch when the conductive and resistive coating is energized by a nominal power supply of 120 $V_{AC}$. This embodiment provides a total power dissipation of about 600 watts for a shelf of about 15 inches by 30 inches, and produces heat at a sufficient wavelength to allow for an absorption rate of energy of 80 percent for many food items. Preferably, the conductive coating, when energized, generates heat which is conducted downward through the substrate to radiate below the substrate and is radiated upward from the conductive coating through the cavity to the cover, where it is conducted through the cover. In a particularly preferred embodiment, the lower surface of the substrate can achieve a temperature of about 350° F. and the upper surface of the cover can achieve a temperature of about 250° F., with both temperatures being infinitely controllable.

Referring to FIGS. 2 and 3, heat flow for heating food items 14 placed within oven 10 is shown. Conductive coating 86 is bonded to and substantially covers upper surface 102 of substrate 100, thereby allowing heat to be substantially evenly distributed across entire shelf 12 when shelf 12 is energized. Heat flow from shelf 12 includes radiant heat or thermal radiation emanating from lower surface 104 of substrate 100 for heating pan 16 or base 18 below shelf 12. Preferably, the radiant heat produced by shelf 12 is electromagnetic radiation having a wavelength of approximately 6.5 microns to provide an approximate 80 percent heat absorption rate into most food items. The heat flow also includes radiant heat from exposed surfaces of shelves 12 not covered by pans 16 on upper surface 110 of cover 108 and from the edge of shelf 12 to heat the sides of pans 16 and the area above pans 16. Heat flow from shelf 12 also includes conductive heat passing through the molecular vibration of the solid cover and pan material, from upper surface 110 of cover 108 to heating pan 16 for heating food items 14 placed on shelf 12. Heat flow also includes convective heat from air movement within food warming oven 10 over the exposed surfaces of shelves 12 to heat pans 16.

Optionally, as shown in FIG. 2, heat may also be radiated in the downward direction by one or more incandescent lights 120 installed in top section 30. In another option, heat can be generated from heat source 88 within base 18 for heating food items 14 placed on shelves 12 above base 18. According to yet another option, heat can be transferred by forced convection through the installation of a fan (not shown) within frame 20 to create air flow across shelves 12. In another option, frame 20 may include a conductive coating with a structure similar to that in FIG. 5 to allow for heat to be generated by that portion of frame 20 to warm food items 14.

In a preferred embodiment, shelves 12 allow transmission of 95%–97% of visible light so that food items 14 beyond or underneath shelves 12 may be readily seen through shelves 12. Transparency is the quality or state of transmitting light without appreciable scattering the light so that bodies lying beyond are entirely visible. In a particularly preferred embodiment, generally transparent shelf 12 has an amber or gold tint. Referring to FIG. 1, food items 14 are placed on shelves 12. Transparent shelves 12 allow a user overhead of shelves 12 to view food items 14 below shelves 12. The user's view is unobstructed by transparent shelf 12, thereby reducing the user's need to stoop or bend to see food items 14 below shelf 12.

In operation, food items 14 are placed on one or more generally transparent heating shelves 12 (preferably through sliding door 60 in rear wall 28). Food warming oven 10 is energized by switching on/off rocker switch 92 to the "on" position. The electric power feed then supplies electricity to shelves 12 and, optionally, to light 120 in top section 30 and additional heat source 88 disposed in base 18. Using thermostat 90, food warming oven 10 is set at the desired warming or cooking temperature. Heat is generated by shelves 12 to warm food items 14. Optionally, added heat may be generated by light 120 (or a metal sheathed element) in top section 30, and/or by heat source 88 in base 18. Light 120 would, of course, also provide light into oven 10 to illuminate food items placed upon heating shelves 12.

In a preferred embodiment, the food warming oven has exterior dimensions of 32.5 inches in width, 26 inches in length, and 31.75 inches in height, and the heating shelf has dimensions of 30 inches length and 15 inches in width. These dimensions allow for the oven to be transported easily and to be placed on or mounted to a work surface (e.g., a counter). The external surfaces of the base and side walls are fabricated from heavy duty, commercial food-grade, stainless steel. The food warming oven controls include selectable on/off switch 92 and thermostat 90 located at rear wall supporting end 36 of base 18. Each generally transparent heating shelf is a thermopane (hermetically sealed double glazing) commercially available from Libbey-Owens-Ford Glass Company of Toledo, Ohio, wherein the conductive coating is bonded to the substrate within the thermopane. The frame is preferably a Glo-Ray model designer heated display case manufactured by the Hatco Corporation of Milwaukee, Wis., and the display case has a thermostatically controlled heated base, full view tempered glass sides and incandescent display lights. The voltage supply to the oven is 120 volts AC (single phase).

While the embodiments illustrated in the FIGURES and described above are presently preferred, it should be understood that these embodiments are offered by way of example only, and various alternatives would be apparent to those of skill in the art. The following provides a number of alternative embodiments.

Figure 7:
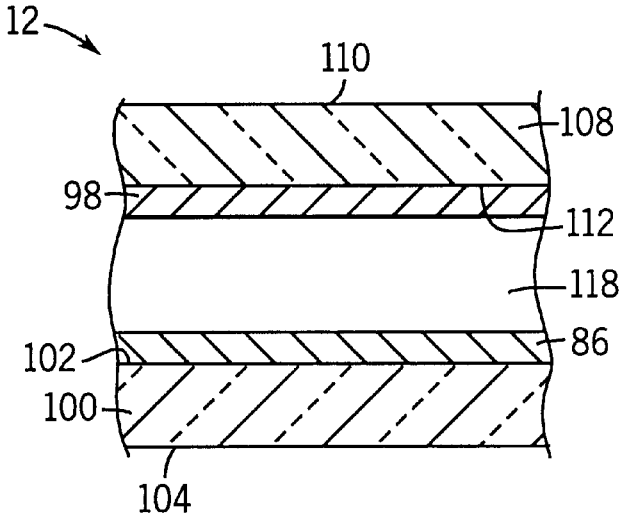
FIG. 7 is a fragmentary, sectional view of a coated shelf according to another alternative embodiment of the present invention.

For example, the oven can include only one transparent heating shelf, or three or more generally transparent heating shelves. For another example, the oven has a generally transparent upper shelf and a non-transparent lower shelf. For yet another example, the oven has one generally transparent shelf disposed above the base, and the base has a generally horizontal upper surface for supporting food items. In another example, the substrate is positioned above and sealed to the cover and the conductive coating is bonded to either the upper surface or the lower surface of the substrate. In a further example, as in FIG. 7, shelf 12 includes a second conductive coating 98 bonded to cover 108. At least one shelf can also be made of a ceramic material. Further, the color of the base, side walls, and top section of the frame can be selected from a number of different colors to coordinate food warming oven with a décor. In additional alternatives, the food warming oven has exterior dimensions of 20.375 inches and 45.5 inches in width, and respectively, 26 inches in length and 31.75 inches in height, but includes shelves of a variety of dimensions. Further, the oven can include a generally transparent lid which entirely encloses the food display area. The oven can include a selectively retractable and positionable, generally transparent lid coupled to the frame. Also, the base can include a heat source such as a heating element, a heat exchanger, a burner, etc. A heat source can also be disposed in the side walls of the oven. The frame can be equipped with one or more lights, such as a shatter resistant incandescent lights, to enhance the food item display while safeguarding the food items from bulb breakage. The oven can include a hinged rear wall door that opens away from the food warming oven. The oven can also include a removable rear wall. The legs of the base may contain glides, rollers, or casters to allow the food warming oven to be easily moved from one location to another location. The thermostat and selectable on/off rocker switch can be disposed along the forward end or on the first or second sides of base or on the side walls. The frame can include a base, generally vertical upwardly extending supports coupled to the base and positioned to support one or more heating shelves. The shelves can be attached to the supports in such a manner to allow for the food items placed on the shelves to be seen and accessed from a multitude of directions.

These alternatives are not exhaustive, and it should be understood that the invention is not limited to a particular embodiment, but extends to various modifications that nevertheless fall within the scope of the appended claims.

What is claimed is:

1. A food warming oven for holding and warming food items, comprising:

a base;

a frame extending upward from the base;

at least one generally transparent heating shelf disposed above the base by the frame, each shelf configured to support at least one food item, each shelf including:

a transparent substrate; and a transparent resistive coating deposited on the substrate; and a power feed electrically coupled to the resistive coating of the at least one heating shelf to heat that shelf and the at least one food item supported by that shelf, and wherein any food items disposed below that shelf are viewable from overhead that shelf.

2. The food warming oven of claim 1 wherein the substrate of each transparent heating shelf is formed of a ceramic material.

3. The food warming oven of claim 1 wherein the substrate of each transparent heating shelf is formed of glass.

4. The food warming oven of claim 1 wherein each transparent heating shelf further includes a cover having a cover edge located at the periphery of the cover, and the substrate has a substrate edge located at the periphery of the substrate, the substrate edge attached to the cover edge to define a cavity disposed between the substrate and the cover.

5. The food warming oven of claim 4 further comprising an insert coupling the substrate edge and the cover edge to define the cavity within each transparent heating shelf.

6. The food warming oven of claim 1 further comprising a non-shelf heating source positioned within the oven for additional warming of the food items in the oven.

7. The food warming oven of claim 1 wherein the resistive coating on each transparent heating shelf includes a chemical vapor deposition ("CVD") pyrolitically coated electrically conductive glass.

8. The food warming oven of claim 1 wherein the resistive coating on each transparent heating shelf has at least one layer selected from the group consisting of silica complex, metallic oxides, metallic nitrides, metallic carbides and combinations thereof.

9. The food warming oven of claim 1 wherein the resistive coating on each transparent heating shelf comprises at least one layer of tin oxide.

10. The food warming oven of claim 1 wherein the resistive coating on each transparent heating shelf is of sufficient thickness to allow for a power density of at least about 1.5 watts per square inch with a nominal supply voltage of about 120 $V_{AC}$.

11. The food warming oven of claim 4 wherein each transparent heating shelf further comprises a second resistive coating deposited on the cover.

12. The food warming oven of claim 11 wherein the transparent substrate of each transparent heating shelf has a lower surface positioned opposite an upper surface, the cover has a lower surface positioned opposite an upper surface, and the resistive coating is at least partially deposited on the substrate to allow the lower surface of the substrate to attain a temperature of at least about 350° F. and the upper surface of the cover to attain a temperature of at least about 250° F.

13. The food warming oven of claim 1 wherein the resistive coating produces heat having an energy absorption rate into the food items of about 80 percent.

14. The food warming oven of claim 1 wherein the resistive coating allows at least about 95 percent of visible light to pass through the transparent heating shelf.

15. The food warming oven of claim 12 wherein the resistive coating is deposited on the lower surface of the substrate to allow the upper surface of the substrate to attain a temperature of at least about 350° F. and the lower surface of the cover to attain a temperature of at least about 250° F.

16. The food warming oven of claim 12 wherein the food items are placed on the upper surface of the cover and below the transparent heating shelf, whereby the food items placed on the upper surface of the cover are heated by conductive heat from the cover and the food items placed below the shelf are heated by radiant heat from the shelf.

17. The food warming oven of claim 1 wherein the frame comprises: a first side wall positioned opposite a second side wall, the first and second side walls extending upwardly generally perpendicular from the base, and a top section coupled to the first and the second side walls, the top section extending over at least a portion of the base.

18. The food warming oven of claim 17 wherein the frame further comprises a rear wall coupled to the base, top section and first and second side walls, and the rear wall, top section, first and second walls and base define an area for displaying the food items.

19. The food warming oven of claim 18 wherein the frame further includes a generally transparent lid extending forwardly and downwardly from the top section to the base, the lid removably coupled to the top section and configured to avoid contact with the shelf and the food items and to substantially enclose the area for displaying the food items.

20. The food warming oven of claim 18 wherein the rear wall is transparent.

21. The food warming oven of claim 18 wherein the rear wall includes a door.

22. The food warming oven of claim 18 wherein the top section further includes a light configured to direct light toward the area for displaying the food items.

23. The food warming oven of claim 19 wherein the transparent lid includes a hinge for opening the lid coupled to the top section and the lid.

24. The food warming oven of claim 1 wherein the power feed further comprises a supply line substantially disposed within the frame.

25. The food warming oven of claim 1 further comprising a thermostat for controlling the temperature of the oven and a switch selectable between a first position and a second position for energizing the food warming oven.

26. The food warming oven of claim 17 wherein the frame includes a chemical vapor deposition pyrolitically coated electrically conductive glass.

27. The food warming oven of claim 1 further comprising a set of legs coupled to the base.

28. A generally transparent shelf for holding and warming food items, comprising:

a substantially transparent substrate;

a resistive coating disposed on the substrate, the resistive coating being generally transparent when disposed on the substrate; and a cover coupled to the substrate.

29. A generally transparent shelf for holding and warming food items, comprising:

a substrate;

a resistive coating disposed on the substrate; and a cover coupled to the substrate, wherein the substrate has a lower surface and a substrate edge located at the periphery of the substrate, and the cover has an upper surface and a cover edge located at the periphery of the cover, wherein the substrate edge is sealed to the cover edge to define a cavity between the substrate and the cover.

30. The transparent shelf of claim 28 wherein the resistive coating is configured for a power density of at least 1.5 watts per square inch with a nominal supply of 120 $V_{AC}$.

31. A generally transparent shelf for holding and warming food items, comprising:

a substrate;

a resistive coating disposed on the substrate; and a cover coupled to the substrate, wherein the resistive coating is configured to allow for a lower surface of the substrate to attain a temperature of at least about 350° F. and an upper surface of the cover to attain a temperature of at least about 250° F.

32. The transparent shelf of claim 28 wherein the resistive coating includes a chemical vapor deposition pyrolitically coated electrically conductive glass.

33. The transparent shelf of claim 28 wherein the resistive coating comprises at least one layer of tin oxide.

34. A method of warming and holding food items using a food warming oven including a base, a frame, at least one generally transparent heating shelf disposed above the base by the frame, each shelf having a resistive coating deposited on a glass substrate, and a power feed electrically coupled to the coating, the method comprising the steps of:

placing food items above and below the transparent shelf; and generating heat by applying power to the resistive coating, wherein the food items placed above and below the transparent heating shelf are heated while the food items placed below the transparent heating shelf are viewable by a user from above the transparent shelf.

35. The method of claim 34 further comprising the step of generating additional heat for the food items by applying power to another heat source disposed in the oven.

36. The method of claim 35 wherein the step of generating heat by applying power to the resistive coating allows an upper surface of the shelf to attain a temperature of about 250° F. and a lower surface of the shelf to attain a temperature of about 350° F.

37. The transparent shelf of claim 28, wherein the substrate, resistive coating, and cover allow transmission of 95 to 97 percent of visible light.

* * * * *